United States Patent [19]

Stamm

[11] 4,185,583

[45] Jan. 29, 1980

[54] SCORE DISPLAY DEVICE

[76] Inventor: Bruno Stamm, 66 Hochstrasse, 8200 Schaffhausen, Switzerland

[21] Appl. No.: 908,416

[22] Filed: May 22, 1978

[30] Foreign Application Priority Data

May 24, 1977 [CH] Switzerland ..... 6405/77

[51] Int. Cl.[2] ..... A63B 71/06

[52] U.S. Cl. ..... 116/225; 273/DIG. 26

[58] Field of Search ..... 116/120, 225; 273/19 R, 273/29 R, 26 EA, 95 AA, DIG. 26; 40/607; 235/68, 123; 35/32, 33

[56] References Cited

U.S. PATENT DOCUMENTS

| | | | |
|---|---|---|---|
| 203,189 | 4/1878 | Orth | 273/DIG. 26 |
| 213,113 | 3/1879 | Jones et al. | 116/120 |
| 964,064 | 7/1910 | Smith | 35/33 |
| 1,211,170 | 1/1917 | Kennedy | 116/120 X |
| 1,404,149 | 1/1922 | Short | 273/29 R |
| 1,853,900 | 4/1932 | Johnson | 116/120 X |
| 2,372,111 | 3/1945 | Norberg | 40/607 X |
| 2,559,302 | 7/1951 | Louft | 40/607 |
| 2,721,398 | 10/1955 | Alonso et al. | 235/123 X |
| 2,803,069 | 8/1957 | Struna | 35/33 X |
| 2,819,547 | 1/1958 | Clements, Jr. | 40/607 X |
| 3,120,213 | 2/1964 | Mulligan | 116/120 X |
| 3,953,028 | 4/1976 | Gowins | 273/26 EA |

FOREIGN PATENT DOCUMENTS

| | | | |
|---|---|---|---|
| 1527512 | 5/1968 | France | 116/120 |

*Primary Examiner*—Daniel M. Yasich

*Attorney, Agent, or Firm*—Pollock, Vande Sande & Priddy

[57] ABSTRACT

A tennis scoring display device including a portable weighted support rod connected to a plurality of transverse display counting rods. The counting rods have counting elements selectively movable from a hidden position. The upper portion of the display device is correspondingly movable 180° as the players change positions in the game court.

7 Claims, 3 Drawing Figures

SCORE DISPLAY DEVICE

The present invention relates to a score display device for indicating the scores of two players or teams located on opposite halves of a play area.

During tennis tournaments where games are played simultaneously on different courts, it is often difficult for spectators to determine the respective scores and to obtain an overview of the progress of play.

Prior art score display devices, while they monitor scoring on a continuing basis, do not take into consideration the frequent changes of place of the players, so that a later arriving spectator finds it difficult to relate the display result to the respective players.

It is an object of the invention to overcome this problem, by means of a symmetrical arrangement comprising at least two counters, one for each half of the play area, rotatable by 180° when the players change sides.

An embodiment of the invention is illustrated by the accompanying drawings, in which.

Figure 1:
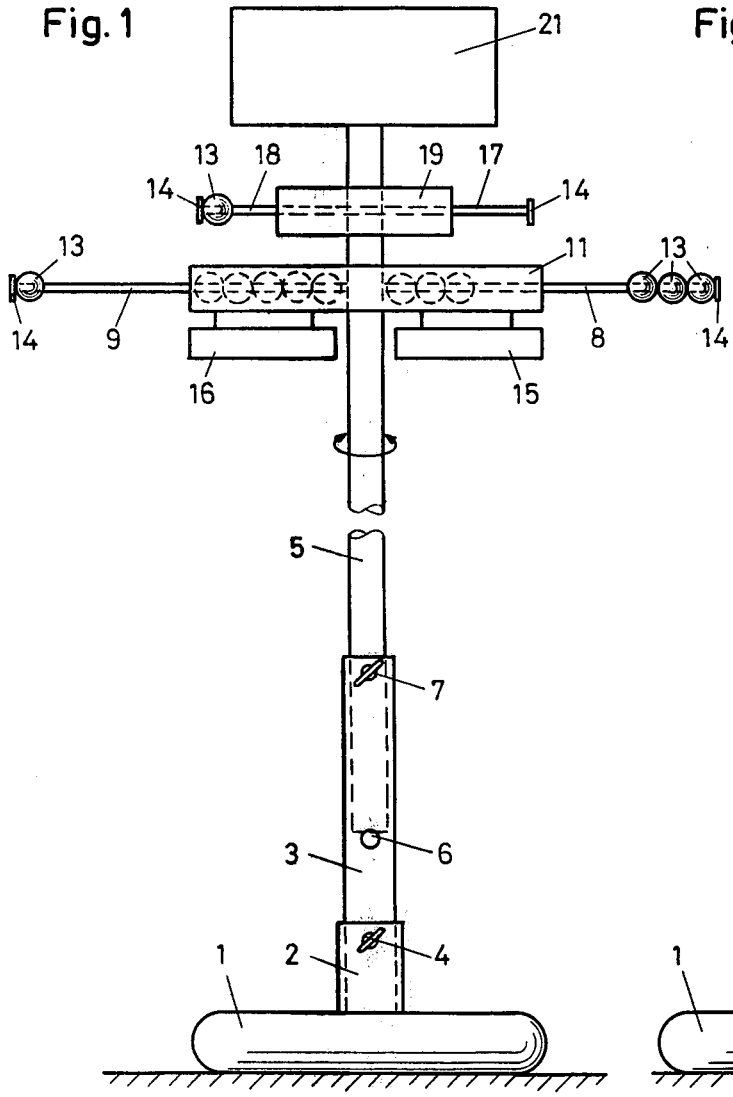
FIG. 1 is front view of a score display device for tennis games.
Figure 2:
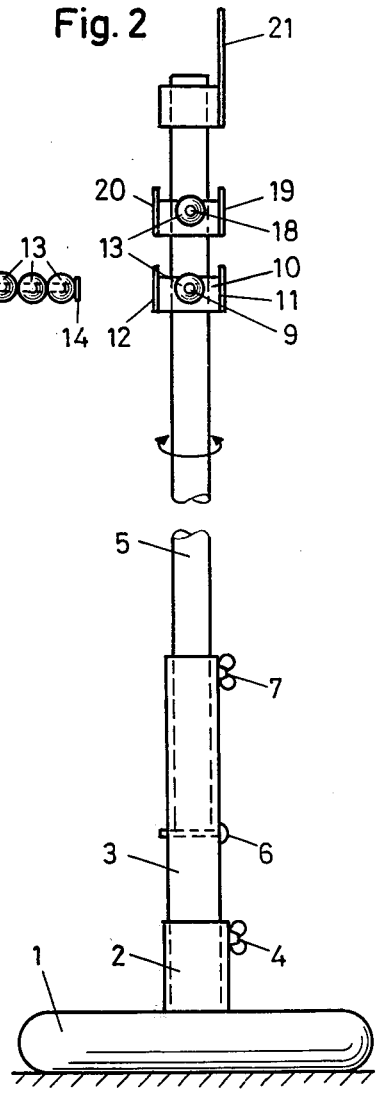
FIG. 2 is a side view of the score display device according to FIG. 1.
Figure 3:
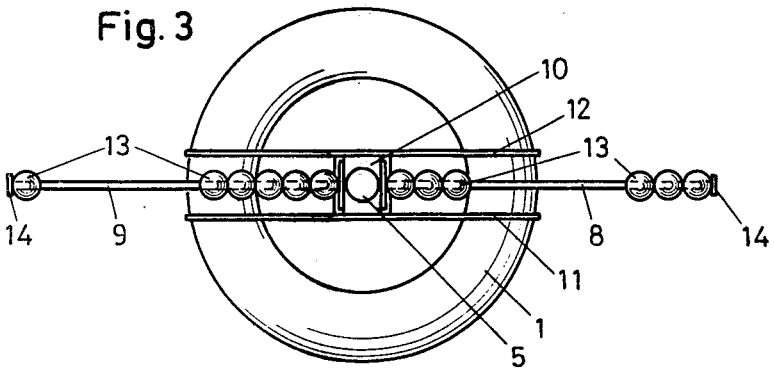
FIG. 3 is a plan view of the score display device, without the upper counter device and the billboard.

The score display device comprises a weighted base 1 having a vertically extending, short four-edged pipe 2, into which a further four-edged pipe 3 is inserted and clamped by means of a wing nut 4. A cylindrical pipe 5 is inserted into pipe 3 and carries, at its top end display boards, counter devices and an advertising billboard. Cylindrical pipe 5 is rotatable relative to four-edged ipe 3 and rests on a peg 6 which may be inserted at different heights in bores in pipe 3. Pipe 5 also can be clamped by means of a wing nut 7.

Two counter rods 8, 9 extending at right angles from cylindrical pipe 5 are screwed into a support 10 removably attached to pipe 5. Each of rods 8, 9 points in the direction of one of the two halves of the play area in which players are located. Support 10 carries two parallel boards 11, 12 which cover rods 8, 9 adjacent support 10. Counting elements, e.g., tennis balls 13, are slidably arranged on rods 8, 9. Depending on the score, the balls can be moved from a hidden position behind boards 11, 12 to a visible position beyond said boards. Tabs 14 are attached to the ends of rods 8, 9 to keep the tennis balls from sliding off.

Rods 8, 9 show the number of games played in the set, and boards 11, 12 are marked accordingly. A name plate 15, 16 can be hung on the "games" board or directly attached thereto.

Above the "games" counter rods, smaller "sets" counter rods 17, 18 and "sets" boards 19,20 are attached to cylindrical rod 5. The latter is provided at its top with a board 21 for advertising or special communications.

As each game is concluded, one of tennis balls 13 is moved on "games" counter rods 8, 9 in the direction of the winner of that game. As soon as a set is won, a tennis ball is moved outwardly on the "sets" counter rods in the direction of the set winner, and the "games" balls are returned to their hidden position. The change of places of the players which now occurs is indicated by rotation of the upper part of the display device by 180°. Thus, the counter rod which relates to a player always shows that half of the court in which the player is located at the time. The various boards and pairs of boards bear the same legends on both sides.

The height of the score display device can be so adjusted that it can be serviced either by the players themselves or by a referee seated on a raised platform. The tennis balls 13 serving as counting elements can be of various colors of the team players during a tennis tournament. Thus the spectators not only have a clear comprehension of the momentary score on a particular court, but can ascertain the position of a team playing on several courts.

The display device can be dis- and reassembled for transport purposes. It can also be adapted for scoring other games, e.g., football, in which case two counter rods 8, 9 may suffice.

What is claimed is:

1. Score display device for indicating the scores of players or teams located on opposite halves of a play area, said device being symmetrical and comprising a support, vertical pepe means extending upwardly from said support two counting devices each pointing to one of said area halves and horizontally rotatable by 180° upon change of sides, said counting devices comprising a first pair of rods extending from said vertical pipe means and counting elements movable along said rods from a hidden inner position to an outer position visible to spectators on opposite sides of said play area.

2. Device according to claim 1, wherein said counting elements comprise tennis balls of different colors.

3. Device according to claim 1, including two parallel boards covering the portions of said first pair of rods adjacent to said vertical pipe means.

4. Device according to claim 3, wherein said parallel boards bear identifications of said players or teams.

5. Device according to claim 1, wherein said vertical pipe means includes a height-adjustable pipe device comprising a first pair of rods extending from said pipe and counting elements movable from a hidden inner position to a visible outer position .

6. Device according to claim 5, including a support removably attached to said vertical pipe means, said first pair of rods being screwed into said support.

7. Device according to claim 1, including a second pair of counting rods attached to said vertical pipe means above said first pair of rods and extending in the same direction as said first pair of rods.

* * * * *